United States Patent [19]

Newman et al.

[11] Patent Number: 4,724,691

[45] Date of Patent: Feb. 16, 1988

[54] LOCK BOLT MECHANISM

[75] Inventors: Donald J. Newman, Sommerville; John A. Christie, Heathmont, both of Australia

[73] Assignee: Ogden Industries Pty. Ltd., Huntingdale, Australia

[21] Appl. No.: 943,361

[22] Filed: Dec. 16, 1986

[30] Foreign Application Priority Data

Dec. 18, 1985 [AU] Australia ..... PH3931

[51] Int. Cl.[4] ..... E05B 63/00

[52] U.S. Cl. ..... 70/221; 70/224; 70/422

[58] Field of Search ..... 70/218, 221, 222, 223, 70/224, 422, 448, 451

[56] References Cited

U.S. PATENT DOCUMENTS

| | | | |
|---|---|---|---|
| 2,055,289 | 9/1936 | Hanan | 70/223 |
| 2,511,522 | 6/1950 | Williams | 70/221 |
| 3,659,444 | 5/1972 | Wellekens | 70/223 |
| 4,394,821 | 7/1983 | Best | 70/422 |

*Primary Examiner*—Robert L. Wolfe

*Attorney, Agent, or Firm*—Berman, Aisenberg & Platt

[57] ABSTRACT

Mechanism for a lock bolt assembly of the kind including a housing, a bolt mounted on the housing for movement into and out of a strike engaging position, an actuator rotatably mounted on the housing, and a drive connection between the actuator and the bolt whereby operation of the actuator causes movement of the bolt. The drive connection includes an override clutch which can be caused to adopt either an engaged condition or a disengaged condition by operation of a key operated lock. In the engaged condition the actuator is drivably connected to the bolt, whereas in the disengaged condition that connection is broken. The clutch operates to resist rotation of the actuator when in the disengaged condition, but that resistance can be overcome by forced operation of the actuator after which the actuator can be rotated freely relative to other parts of the mechanism.

15 Claims, 7 Drawing Figures

LOCK BOLT MECHANISM

Figure 1:
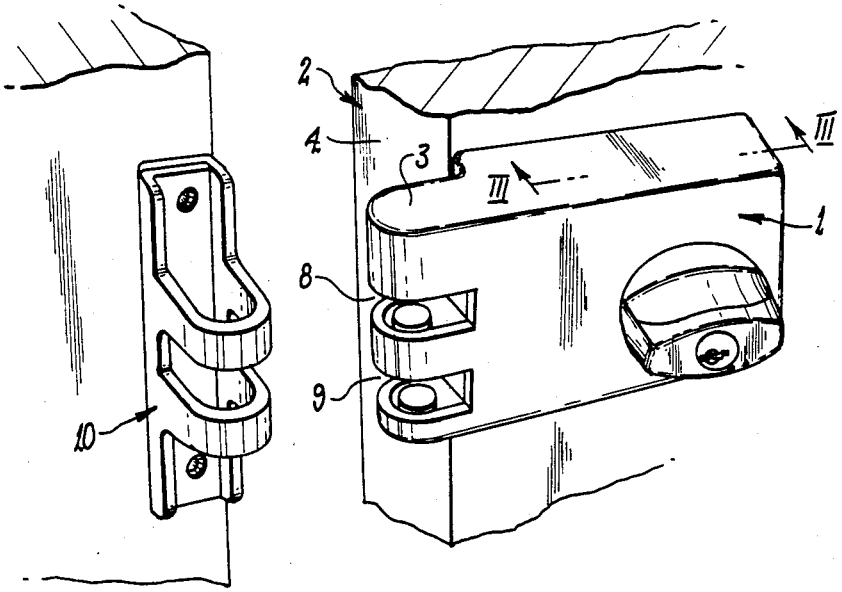

This invention relates to lock bolt mechanism such as latch bolt and deadbolt mechanisms. It will be convenient to hereinafter describe the invention with particular reference to deadbolts, but it is to be understood that the invention has wider application.

A deadbolt assembly normally includes inside and outside actuators. The outside actuator is typically a key operated cylinder, whereas the inside actuator can be either a manually operable turn knob or a key operated lock. If a turn knob is employed the deadbolt assembly may also include a security feature which is selectively operable to hold the turn knob against rotation and thereby prevent operation of the deadbolt from the inside of the door. It has been found, however, that such a security feature can be defeated by applying a tool such as a wrench to the turn knob and forcing the turn knob to turn against the resisting influence of the security feature. A principal object of the present invention is to provide in a lock bolt mechanism of the kind having a turn knob, security means which is operable to effectively prevent improper actuation of the lock bolt by turning movement of the turn knob.

The security means of the present invention is characterised in that it includes an overriding clutch which is operable to disconnect the turn knob from the lock bolt and thereby render rotation of the turn knob ineffective for the purpose of operating the lock bolt. That concept can be applied in a variety of ways, and it will be convenient to hereinafter describe a particular form of the invention as applied to a deadbolt assembly. The same concept could be applied to latch bolt assemblies with equal effectiveness. Again by way of example, the deadbolt assembly hereinafter described is of the type in which the path of movement of the deadbolt is substantially parallel to an upright edge of the door with which the assembly is associated when in use. The invention is also applicable to deadbolt assemblies in which the bolt moves transverse to the door upright edge.

According to one aspect of the present invention, there is provided a lock bolt mechanism including, a housing, a lock bolt mounted on said housing for movement relative thereto, an actuator rotatably mounted on said housing, a drive connection between said actuator and said lock bolt whereby said bolt is caused to move in response to rotation of said actuator, clutch means included in said drive connection and being arranged to adopt either an engaged condition or a disengaged condition at which said drive connection is completed and broken respectively, and operating means mounted on said housing and being operable to cause said clutch means to adopt a selected one of said conditions.

According to a further aspect of the invention, there is provided a lock bolt assembly including, a hollow housing having a front wall and an open back, a circular opening formed through said front wall, an actuator having a hand engageable part which is rotatably located in said circular opening and projects forwardly of said front wall and a mounting part which abuts against a rearwardly facing surface of said front wall, a lock bolt mounted on said housing for movement relative thereto, and a drive connection between said actuator and said lock bolt whereby said bolt is caused to move in response to rotation of said actuator.

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 7:
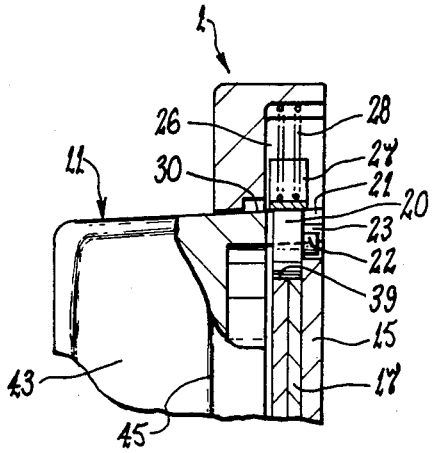
Figure 2:
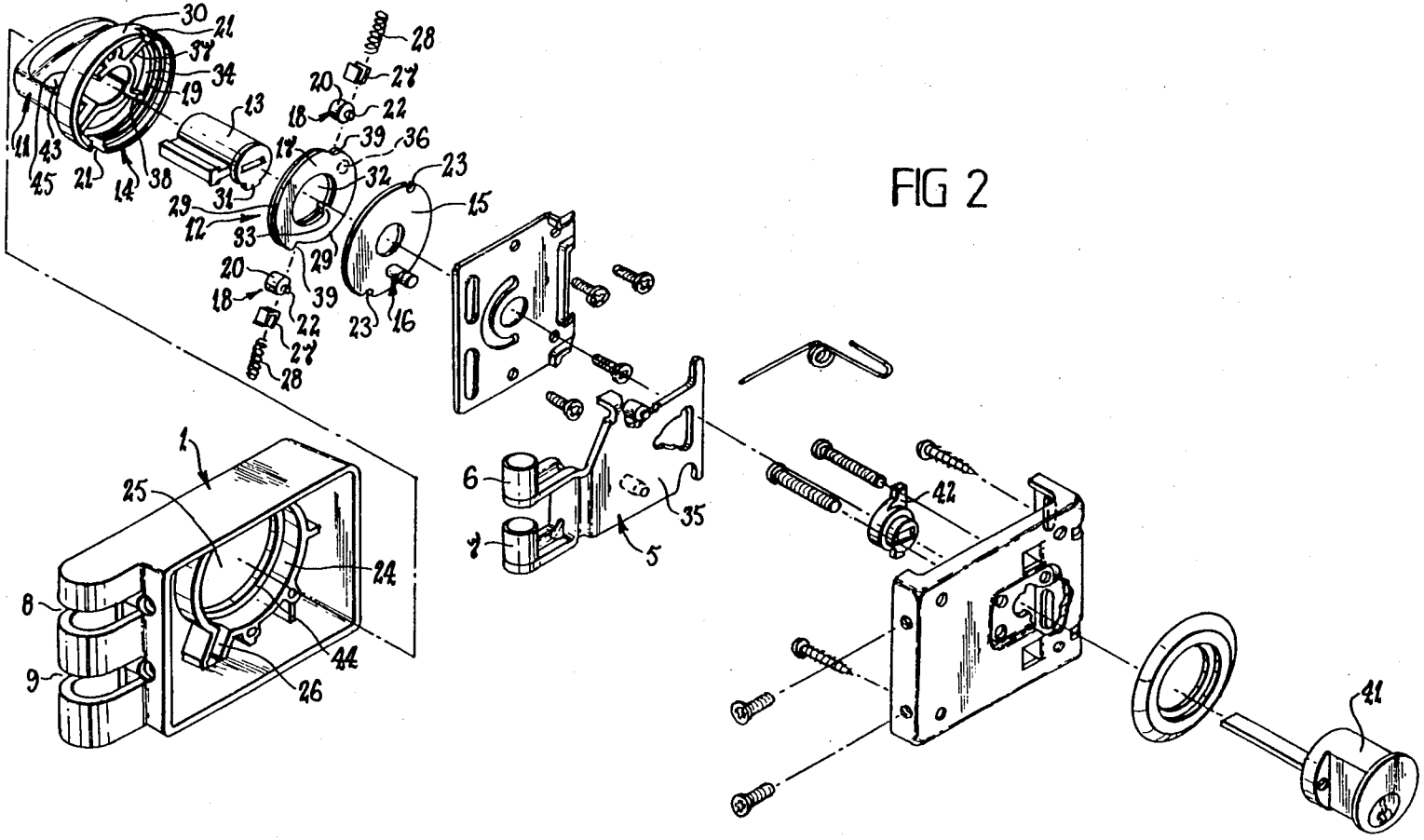
Figure 3:
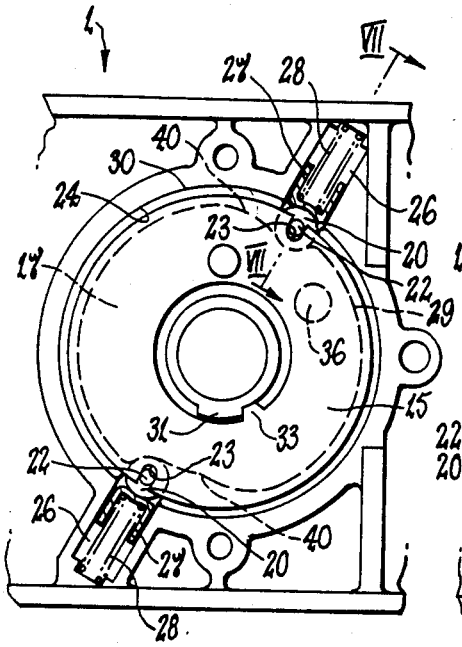
Figure 4:
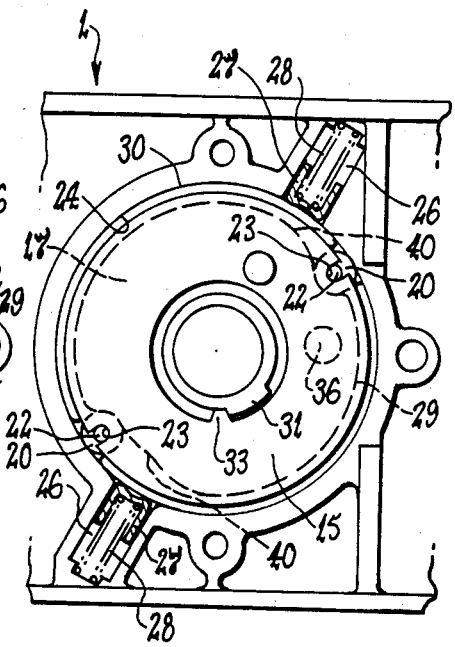
Figure 5:
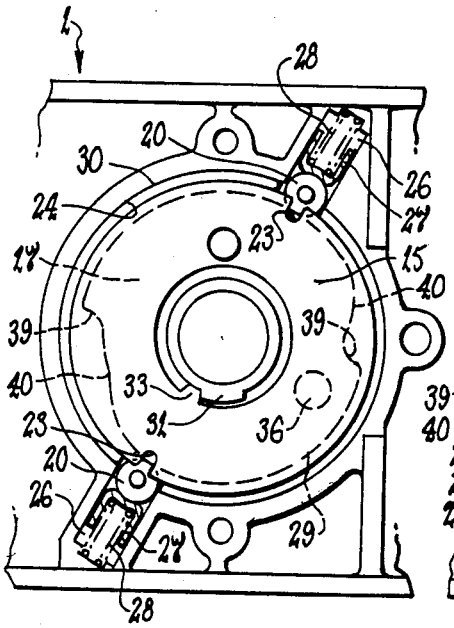
Figure 6:
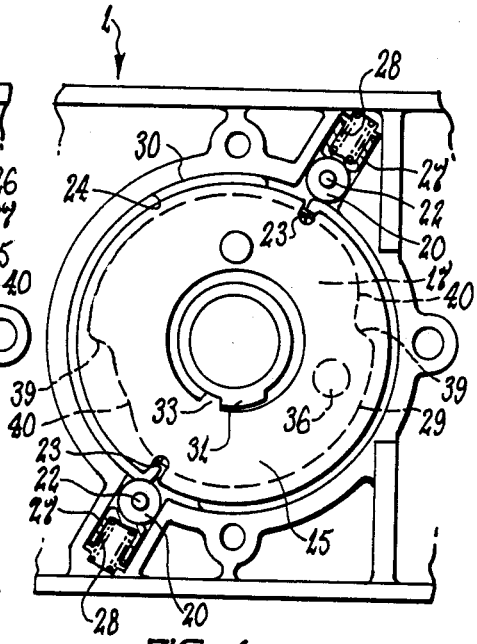

In the drawings:

FIG. 1 is a perspective view of one form of deadbolt assembly to which the invention is applicable, FIG. 2 is an exploded perspective view of one embodiment of the invention as applied to a deadbolt assembly, FIG. 3 is a cross-sectional view taken along line III—III of FIG. 1, with parts being omitted for convenience of illustration, showing the mechanism of FIG. 2 in an unlocked condition, FIG. 4 is a view similar to FIG. 3 but showing the mechanism partially operated by the turn knob, FIG. 5 is a view similar to FIG. 3 but showing the mechanism in the locked condition, FIG. 6 is a view similar to FIG. 5 but showing the mechanism moved to a condition as a result of forced actuation of the turn knob, FIG. 7 is a cross-sectional view taken along line VII—VII of FIG. 3.

A typical deadbolt assembly to which the invention is applicable is shown by FIG. 1 and includes a hollow housing 1 or case which is attachable to the inside surface of a door 2. A front edge portion 3 of the housing 1 is arranged to project beyond the front upright edge 4 of the door 2 and that edge portion 3 contains the bolt 5. The bolt 5 is best seen in FIG. 2 and includes two aligned and axially spaced cylindrical parts 6 and 7 which are interconnected as hereinafter described for simultaneous up and down movement. Two recesses 8 and 9 are provided within the housing front edge portion 3 to receive the strike 10 and each bolt part 6 and 7 extends across a respective one of those recesses 8 and 9 when the deadbolt assembly is in the operative condition, whereas the bolt parts 6 and 7 are located clear of the recesses 8 and 9 when the assembly is inoperative as shown in FIG. 1. A rotatable turn knob 11 is mounted on the housing 1 and a drive connection provided within the housing 1 is operable to connect the turn knob 11 and the bolt 5.

Deadbolt assemblies of the foregoing kind are well known and such an assembly is modified in accordance with the present invention by addition of security means including an overriding clutch 12 (FIG. 2).

A preferred form of the security means is shown in FIG. 2 and includes operating means in the form of a key operated lock 13 and a pin tumbler cyulinder lock has been found satisfactory for that purpose. The overriding clutch 12 is rendered operable or inoperable by the lock 13 and the clutch 12 is included in the drive connection between the turn knob 11 and the bolt 5.

In the particular arrangement shown, the drive connection includes a drive member 14 and a driven member 15, both of which are preferably mounted for rotation about substantially the same axis, and the clutch 12 is provided between those members. The drive member 14 is connected to or formed by the turn knob 11 and the driven member 15 is connected to the deadbolt 5 so as to be operable to cause movement of that bolt 5 between its operative and inoperative conditions.

The turn knob 11 as shown includes a cylindrical mounting section which functions as the drive member 14 and is rotatably mounted within a complementary bore 25 formed within the housing 1. According to the preferred arrangement shown, that cylindrical section 14 is hollow so as to receive other components of the deadbolt assembly such as the clutch 12 and the driven member 15. It is also preferred that the driven member 15 is in the form of a disc as shown which is arranged coaxial with the cylindrical section 14 of the knob 11 and any suitable means may be provided for connecting that disc 15 to the deadbolt 5. In the example shown, an eccentrically arranged pin 16 secured to the disc 15 is arranged to move the deadbolt 5 in response to rotation of the disc 15.

One suitable form of clutch 12 is shown in FIG. 2 and includes a cam plate 17 and at least one cam followed 18 which comprises or influences a drive dog through which drive is transmitted from the turn knob 11 to the disc 15. Preferably, as shown, there are two such drive dogs 18 located at respective opposite sides of the turn knob axis. Also in the preferred construction shown, the cam plates 17 and the driven disc 15 are located in substantially face to face relationship within the hollow cylindrical mounting section 14 of the turn knob 11. It is generally convenient to locate the cam plate 17 between the driven disc 15 and a rearwardly facing surface 19 of the turn knob 11.

Each drive dog 18 preferably comprises an element which extends between and engages with both the cylindrical mounting section 14 of the turn knob 11 and the driven disc 15. In the example shown, that element has a cylindrical roller-type body 20 which has its axis substantially parallel to the rotational axis of the turn knob 11 and which seats within a recess 21 provided in the periphery of the turn knob mounting section 14. An axial projection 22 at one end of that roller 20 engages within a peripheral recess 23 of the driven disc 15. The arrangement is such that the roller 20 moves with the turn knob 11 as that knob 11 rotates and consequently transmits drive to the driven disc 15 through the axial projection 22 and engaging recess 23 of the driven disc 15. Each of the turn knob and disc recesses 21 and 23 is open at the periphery of its respective member for a reason hereinafter made clear.

The turn knob recesses 21 are of such a depth that the respective roller 20 can be located completely within the periphery of the cylindrical mounting section 14 and that is the position adopted by the roller 20 when the clutch 12 is inoperable (FIG. 3). In that position of the roller 20, it tracks around the surrounding surface 24 of the housing bore 25 when the turn knob 11 is rotated. Two locking cavities 26 are provided in that surrounding surfaces 24 in diametrically opposed relationship and each is dimensioned so as to be capable of neatly receiving a respective one of the rollers 20.

Biasing means may be associated with each cavity 26 and arranged to resist movement of a roller 20 into the respective cavity 26. In the construction shown, each such biasing means includes a spring influenced plunger 27 which is slidably mounted within the respective cavity 26 and is arranged to effectively block entrance of a roller 20 into that cavity 26. A coil compression spring 28 acts betwen the plunger 27 and the base of the respective cavity 26.

The cam plate 17 is preferably mounted for rotation about substantially the same axis as the turn knob 11 and is disposed so that its outer edge 29 is located between and is engageable with the two rollers 20. That outer edge 29 forms a cam surface which is operable to influence the position of each roller 20 relative to the turn knob axis. When the cam plate 17 is rotated into a locked position (FIG. 5), however, the cam surface 29 pushes each roller 20 outwards so that it projects beyond the outer surface 30 of the turn knob mounting section 14. Such outward travel of the roller 20 is only possible when each roller 20 is aligned with a respective housing cavity 26 as hereinafter described.

It is preferred that stop means is provided to limit the extent of rotation of the cam plate 17 relative to the turn knob 11 and the two extremes of that limited rotation may constitute the locked and unlocked positions respectively. Rotation between those positions is preferably controlled by a key operated lock 13 as previously mentioned and the body of that lock may be located within the turn knob 11 so as to rotate with that knob 11. In particular, the axis of rotation of the lock barrel is preferably substantially coincident with the rotational axis of the turn knob 11.

In the particular construction shown, the barrel of the lock 13 is rotated through 360° between the locked and unlocked positions of that means, whereas the cam plate 17 requires less movement—e.g., approximately 60° movement. That difference is movement may be compensated by a lost motion connection between the barrel of the lock 13 and the cam plate 17. In the example shown, a drive lug 31 fixed to the barrel of the lock 13 locates within a central opening 32 of the cam plate 17 so as to be engageable with a cooperable lug 33 of the cam plate 17 which projects inwardly from the edge of that opening 32. The arrangement is such that the barrel lug 31 can move relative to the cam plate 17 through approximately 300° before engaging the cam plate lug 33.

Any suitable means may be adopted to hold the cam plate 17 so that it rotates about the axis previously referred to. According to the arrangement shown, that means includes a cylindrical projection 36 (FIGS. 3 to 6) which extends outwardly from one face of the cam plate and locates and tracks within a curved groove 34 formed in an opposed face of the turn knob 11. The opposite ends 37 and 38 of that groove 34 may form part of the aforementioned stop means.

The deadbolt 5 preferably includes a carrier plate 35 which is arranged within the housing 1 so as to be movable relative thereto in the axial direction of the bolt parts 6 and 7. Any suitable guide means may be employed for that purpose. The eccentric pin 16 of the driven disc 15 engages with the carrier plate 35 so that rotation of the driven disc 15 is translated into linear movement of the carrier plate 35.

In the preferred construction shown, the driven disc 15 and carrier plate 35 are constructed and adapted to cooperate as described in our copending U.S. patent application Ser. No. 943,362 entitled "Deadbolt Assembly" filed Dec. 18, 1985. The driven disc 15 of that construction is arranged to move through approximately 180° for the purpose of moving the deadbolt 5 between its operative and inoperative positions, and means may be provided to prevent substantial rotation of the disc 15 beyond that range of movement.

When the lock 13 is in the unlocked condition (FIG. 3), rotation of the turn knob 11 in say the anti-clockwise direction will result in the deadbolt 5 being moved from the inoperative condition to the operative condition. In that position of the lock 13, the cam plate 17 is arranged so that each drive dog roller 20 is at its radially innermost position and can therefore track around the surrounding surface 24 of the housing bore 25 as shown in FIG. 4. Also in that position, the cam plate projection 36 is engaged by the turn knob 11 so that the turn knob 11 and cam plate 17 turn in unison in the anti-clockwise direction. Alternatively or additionally, rotation may be imparted to the cam plate 17 through each drive dog roller 20 engaging an abrupt step 39 in the peripheral edge 29 of the cam plate 17.

Rotation of the turn knob 11 also causes rotation of the driven disc 15 because of the engagement of the drive dog rollers 20 with both the turn knob 11 and the driven disc 15. As a consequence the driven disc 15 causes the deadbolt 5 to move from the inoperative position to the operative position.

Reverse rotation of the turn knob 11 in the clockwise direction back towards its original position naturally causes rotation of the cam plate 17 and driven disc 15 in the same direction so that the deadbolt 5 returns towards its inoperative position. During that movement there is no change in the relative positions of the turn knob 11 and cam plate 17. Each drive dog roller 20 is in radial alignment with a respective locking cavity 26 of the housing 1 when the turn knob 11 is at both of its positions at which the deadbolt 5 is inoperative and operative respectively.

Assuming the turn knob 11 is at the last mentioned position, the lock 13 can be actuated through the use of an appropriate key so as to render the overriding clutch 12 operable. That operation includes turning the barrel of the lock 13 in the anti-clockwise direction relative to the turn knob 11. As a consequence of that movement, the barrel lug 31 is initially moved away from the cam plate lug 33, but those lugs 31 and 33 eventually re-engage after the lock barrel has moved through approximately 300°. Continued movement of the lock barrel then causes corresponding movement of the cam plate 17 and a ramping section 40 of the cam plate peipheral edge 29 is thereby moved against each drive dog roller 20 so as to urge those rollers 20 radially outwards.

Such radial outward movement of the rollers 20 is made possible because of their alignment with a respective locking cavity 26. As a result of that alignment, each roller 20 is engaged by a respective one of the plungers 27, and each roller 20 is able to move outwards by pushing the respective plunger 27 back into the locking cavity 26. At the end of the rotation of the cam plate 17, each roller 20 will have been lifted through a distance such that it is partly located in the adjacent locking cavity 26 and partly located in the respective turn knob recess 21 as shown in FIG. 5. Preferably, the roller axis is located in or near the plane of the housing bore surface 24. Also, at that position of each roller 20, its axial projection 22 is completely removed from the respective peripheral recess 23 of the driven disc 15 and consequently the drive connection between the turn knob 11 and driven disc 15 is broken.

Since the rollers 20 bridge between the turn knob 11 and housing 1, they provide a positive resistance to rotation of the turn knob 11 relative to the housing 1. The arrangement is preferably such that the turn knob 11 cannot be rotated by hand. If an attempt is made to force the turn knob 11 to rotate, such as by applying a wrench or other tool to the turn knob 11, an edge of each turn knob recess 21 will be pressed against the cylindrical surface of the adjacent roller 20 and that will cause the roller 20 to be cammed further outwards to the position shown in FIG. 6. Such camming action permits the turn knob 11 to rotate relative to the housing 1, but the driven disc 15 remains stationary because of the absence of a connection between it and the turn knob 11. Each roller 20 will be forced into the respective locking cavity 26 as shown in FIG. 6 so that the turn knob 11 can rotate relatively freely, again without having any influence on the rotational position of the driven disc 15 and consequently there is no change in the position of the deadbolt 5. During that rotation of the turn knob 11, each roller 20 bears on the cylindrical outer surface 30 of the turn knob mounting section 14 and is thereby held in its respective cavity 26, and that condition will remain so long as the barrel of the lock 13 is positioned as described above.

Return of the clutch 12 to an inoperative condition is effected by reversing the aforementioned operation. That is, the key is used to turn the barrel of the lock 13 back through its 360° of movement and in the course of that movement the cam plate 17 is returned to its original position at which it frees the rollers 20 for radial inward movement. Assuming the turn knob 11 is correctly positioned relative to the housing 1, each roller 20 is then able to move into its respective turn knob recess 21 and as a consequence the axial projection 22 of that roller 20 engages within a respective recess 23 of the driven disc 15. Drive connection between the turn knob 11 and drive disc 15 is thereby restored.

With the foregoing arrangement the key operated lock 41 which forms the outside actuator can continue to influence the position of the deadbolt 5 regardless of the condition of the overriding clutch 12. If the clutch 12 is operative, the outside lock 41 can function to rotate the driven disc 15 because of its disconnection from the turn knob 11 and thereby change the position of the deadbolt 5. If the clutch 12 is inoperative, the outside lock 41 can still function as required, but in that event the turn knob 11 will rotate with the driven disc 15.

In the example construction shown in FIG. 2, the outer lock 41 is a pin tumbler cylinder lock and a drive bar 42 connected to the inner end of the barrel of the lock 41 is engageable with the eccentric pin 16 of the driven disc 15. If the barrel rotates through 360° between its two conditions of operation, the drive bar 42 may be arranged to move through 180° in either direction before engaging the driven disc pin 16.

It will be apparent from the foregoing description that the overriding clutch 12 provides effective security means which prevents forced operation of the deadbolt 5 and furthermore prevents the associated mechanism being damaged by forced rotation of the turn knob 11.

The security of an arrangement as described may be further improved by mounting the turn knob 11 so that it cannot be forced to separate from the mechanism housing 1. In the past such turn knobs have been held against separation from the housing by a circlip or retaining plate, and it has been possible to overcome the restraining influence of such devices by force and thereby separate the turn knob from the housing. Such separation enables access to the mechanism so that improper actuation of the deadbolt is possible. It will be appreciated that the improved turn knob mounting described below can be used with the housing for mechanisms other than that particularly described above, including both latch bolt and deadbolt mechanism housings.

According to a further aspect of the present invention, the aforementioned problem is overcome or minimised by having the mounting section 14 of the turn knob 11 dimensioned so that it extends laterally beyond the hand engageable part 43 of the knob 11. The housing bore 25 which receives that mounting section 14 extends into the housing 1 from a rear side thereof and is stepped down between the front and rear sides of the housing to provide a rearwardly facing annular shoulder 44. With that arrangement, the turn knob 11 is positioned in the housing bore 25 from the rear side of the housing 1 so that an end face 45 of the mounting section 14 abuts against the shoulder 44. The hand engageable part 43 of the turn knob 11 extends through the smaller section of the housing bore 25 to project beyond the front side of the housing 1.

Such an arrangement provides firm resistance to separation of the turn knob from the housing. Indeed, such separation would require destruction of a substantial part of the turn knob and/or the housing. This particular aspect of the invention may or may not be used with an overrriding clutch as previously described.

Various alterations, modifications and/or additions may be introduced into constructions and arrangements or parts previously described without departing from the spirit or ambit of the invention as defined by the appended claims.

Having now described our invention, what we claim as new and desire to secure by Letters Patent is:

1. A lcok bolt assembly including, a hollow housing having a front wall and an open back, a circular opening formed through said front wall, an actuator having a hand engageable part which is rotatably located in said circular opening and projects forwardly of said front wall and a mounting part which abuts against a rearwardly facing surface of said front wall, said hand engageable part being formed integral with said mounting part, said mounting part being immovable relative to the hand engageable part and including an annular surface which abuts against said rearwardly facing surface, a lock bolt mounted on said housing for movement relative thereto, and a drive connection between said actuator and said lock bolt whereby said bolt is caused to move in response to rotation of said actuator.

2. A lock bolt mechanism including, a housing, a lock bolt mounted on said housing for movement relative thereto, an actuator rotatably mounted on said housing, a drive connection between said actuator and said lock bolt whereby said bolt is caused to move in response to rotation of said actuator, clutch means included in said drive connection and being arranged to adopt either an engage condition or a disengaged condition at which said drive connection is completed or broken respectively, at least one drive dog forming part of said clutch means and which is movable between a drive engage position at which said drive connection is complete and a drive release position at which said drive connection is broken, said movement of the drive dog being in a generally radial direction relative to the axis of rotation of said actuator, said drive dog engaging with said actuator when in said drive release position so as to apply a restraining influence to said actuator whereby rotation of said actuator is resisted, and operating means mounted on said housing and being operable to cause said clutch means to adopt a selected one of said conditions.

3. Mechanism according to claim 2, wherein said clutch means includes a cam plate which is mounted for rotation relative to said housing and is engageable with said drive dog so as to influence the position of said drive dog, and said cam plate is rotatable in response to operation of said operating means.

4. Mechanism according to claim 2, wherein said drive connection includes a rotatable drive plate, a pin fixed to said drive plate for movement therewith and being located radially outwards from the axis of rotation of said drive plate, and means on said lock bolt which cooperates with said pin so that said lock bolt moves in response to rotation of said drive plate.

5. Mechanism according to claim 2, wherein said housing is hollow and has a front wall and an open back, a circular opening is formed through said front wall, and said actuator includes a hand engageable part which is rotatably located in said circular opening and projects forwardly of said front wall and a mounting part which abuts against a rearwardly facing surface of said front wall.

6. A lock bolt mechanism including, a housing, a lock bolt mounted on said housing for movement relative thereto, an actuator rotatably mounted on said housing, a drive connection between said actuator and said lock bolt whereby said bolt is caused to move in response to rotation of said actuator, clutch means included in said drive connection and being arranged to adopt either an engaged condition or a disengaged condition at which said drive connection is completed and broken respectively, at least one drive dog forming part of said clutch means and which is movable between a drive engage position at which said drive connection is complete and a drive release position at which said drive connection is broken, said movement of the drive dog is in a direction generally radially relative to the axis of rotation of said actuator, a rotatable drive plat forming part of said drive connection and being operatively connected to said lock bolt, said dog engages with both said actuator and said drive plate when in said drive engage position so as to thereby provide a drive interconnection between the actuator and the drive plate, and operating means mounted on said housing and being operable to cause said clutch means to adopt a selected one of said conditions.

7. Mechanism according to claim 6, wherein said clutch means, when in said disengaged condition, applies a restraining influence on said actuator so as to resist rotation of said actuator relative to said housing.

8. Mechanism according to claim 7, wherein said clutch means is responsive to forced rotation of said actuator so as to release said restraining influence.

9. Mechanism according to claim 6, wherein said dog is freed from engagement with said drive plate when in said drive release position.

10. Mechanism according to claim 6, wherein said dog remains in engagement with said actuator when in said drive engage position, and reacts with said actuator in response to forced rotation of the actuator so as to be urged out of that engagement and thereby release said actuator for rotation free of said drive connection.

11. A lock bolt mechanism including, a housing, a lock bolt mounted on said housing for movement relative thereto, an actuator rotatably mounted on said housing, a drive connection between said actuator and said lock bolt whereby said bolt is caused to move in response to rotation of said actuator, clutch means included in said drive connection and being arranged to adopt either an engaged condition or a disengaged condition at which said drive connection is completed and broken respectively, at least one drive dog forming part of said clutch means and being movable between a drive engage position at which said drive connection is complete and a drive release position at which said drive connection is broken, said movement of the drive dog is in a direction generally radially relative to the axis of rotation of said actuator, a cam plate forming part of said clutch means and being mounted for rotation relative to said housing, said cam plate being engageable with said drive dog so as to influence the radial position of that dog, and operating means mounted on said housing and being operable to cause rotation of cam cam plate and thereby cause said clutch means to adopt a selected one of said conditions.

12. Mechanism according to claim 11, wherein said drive dog, when in said drive engage position, engages with said actuator so as to move with said actuator as said actuator is rotated and also engages with said cam plate to cause said cam plate to rotate with said actuator.

13. Mechanism according to claim 12, wherein said cam plate is rotatable relative to said actuator between a locked and an unlocked position, said operating means is operable to cause said relative rotation, and said drive dog moves into said drive release position in response to said cam plate moving into said locked position.

14. Mechanism according to claim 13, wherein said operating means is a key operated lock, and lost motion means is provided in the connection between said lock and said cam plate such that said cam plate rotates in response to part only of the operation of said lock.

15. A lock bolt mechanism including, a housing, a lock bolt mounted on said housing for movement relative thereto, an actuator rotatably mounted on said housing, a drive connection between said actuator and said lock bolt whereby said bolt is caused to move in response to rotation of said actuator, clutch means included in said drive connection and being arranged to adopt either an engaged condition or a disengaged condition at which said drive connection is completed and broken respectively, a rotatable drive plate forming part of said drive connection, a pin fixed to said rotatable drive plate for movement therewith and being located radially outwards from the axis of rotation of said drive plate, means on said lock bolt which cooperates with said pin so that said lock bolt moves in response to rotation of said drive plate, and operating means mounted on said housing and being operable to cause said clutch means to adopt a selected on said conditions.

* * * * *